US005438896A

United States Patent [19]

Carroll

[11] Patent Number: 5,438,896

[45] Date of Patent: Aug. 8, 1995

[54] KNIFE PEN FOR PROGRAM-CONTROLLED PLOTTERS

[75] Inventor: Bill E. Carroll, Oklahoma City, Okla.

[73] Assignee: AT&T Corp., Murray Hill, N.J.

[21] Appl. No.: 127,723

[22] Filed: Sep. 28, 1993

[51] Int. Cl.[6] ..... B26D 3/08

[52] U.S. Cl. ..... 83/76.1; 83/76.9; 83/433; 83/579; 83/614; 33/18.1; 33/32.3

[58] Field of Search ..... 83/13, 34, 56, 76.6, 83/76.9, 433, 579, 613, 614, 76.1; 33/18.1, 1 M, 32.3

[56] References Cited

U.S. PATENT DOCUMENTS 5,074,178 12/1991 Shetley et al. ..... 83/47

5,094,134 3/1992 Mizukoshi ..... 33/18.1 X 5,188,009 2/1993 Sunohara et al. ..... 83/13

5,197,198 3/1993 Onozato ..... 33/32.3 X

*Primary Examiner*—Richard K. Seidel

*Assistant Examiner*—Raymond D. Woods

*Attorney, Agent, or Firm*—Michael B. Johannesen

[57] ABSTRACT

An apparatus for cutting labels or other material in a program-controlled plotter comprising a blade affixed in a shaft which, in turn, is rotably held in a shell which can be mounted in a plotter. Advantageously, the blade is mounted so that the cutting point is not on axis with the center line, but trails slightly so that when the direction of travel is changed, the blade rotates to adjust to the new cutting direction.

7 Claims, 3 Drawing Sheets

KNIFE PEN FOR PROGRAM-CONTROLLED PLOTTERS

TECHNICAL FIELD

This invention relates to program-controlled plotters and, more specifically, to a cutting device usable in a plotter that may be used to, advantageously, cut out labels.

BACKGROUND OF THE INVENTION

Program-controlled plotters can print many things that cannot be printed on laser or dot matrix-type printers. For example, large blueprints and other line drawings that require oversized or outsized paper are advantageously printed on plotters. Additionally, most modern plotters provide for drawing in multiple colors by having interchangeable pens, which are stored in a carousel that is indexable by program control so that any pen in the carousel may be accessed by the pen carrier of the plotter.

One printing application that has not been successfully transferred to computers is the generation of adhesive labels. There are several commercially available programs which permit computers to print labels on precut stock. However, the programmer must work within the lines of the pre-cut label stock. In applications where unusual sized or shaped labels must be generated, the programmer must go to the label manufacturer and have custom label sheets cut in order to have just the right size needed.

Therefore, there is a need in the art for a means to generate custom sized and shaped labels.

SUMMARY OF THE INVENTION

This invention provides an apparatus for cutting paper and other similar material in a program-controlled plotter. A blade is affixed to the bottom of a shaft which, in turn, is rotably held within a shell which can be mounted in a plotter as if it were a plotter pen. Advantageously, the blade is mounted so that the cutting tip is not on axis with the center line, but trails slightly, whereby the blade's cutting tip follows an arc to adjust to the new cutting direction.

BRIEF DESCRIPTION OF THE DRAWING

A more complete understanding of the invention may be obtained from consideration of the following description, in conjunction with the drawings in which.

DETAILED DESCRIPTION

Figure 1:
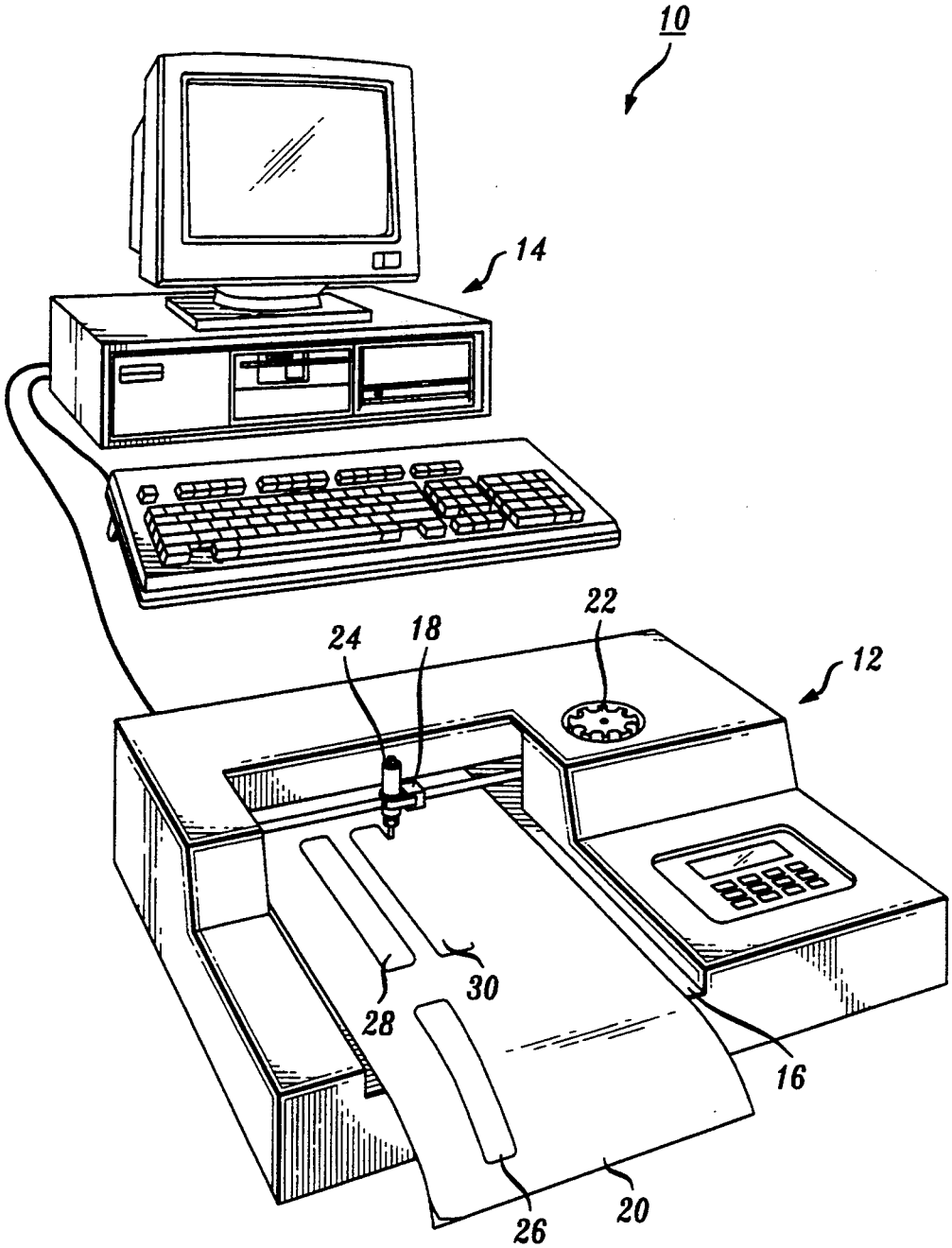
FIG. 1 is an illustration of this invention cutting out adhesive labels in connection with a plotter under control of a personal computer.

An exemplary embodiment of a plotter-usable knife pen is illustrated in a system 10 which can print and cut out adhesive labels. Plotter 12 is connected to personal computer 14 and responds to plotter commands as is known in the art. Plotter 12 may be, for example, an HP 7550A, or HP 7580B, as manufactured by the Hewlilt Packard Corporation. Personal computer 14 may be any program-controlled personal computer, or for that matter, any stored program-controlled computer which can generate commands to operate plotter 12.

Plotter 12 comprises, as is generally known in the art, a base or shell 16 upon which the work piece rests, and a mechanical pen holder or carrier 18. As is known in the art, pen carrier 18 moves in one plane and the base 16 of plotter 12 includes a friction-based mechanism that moves material 20 in a plane perpendicular to pen carrier 18. In this manner, all forms of lines, letters and numbers may be drawn by the combination of the movement of material 20 and the pen carrier 18.

Pen carrier 18 also works in cooperation with carousel 22. Carousel 22 holds a plurality of pens that can be alternately selected by pen carrier 18, so that, for example, the thickness of line or color of ink may be changed.

In the illustration of FIG. 1, pen carrier 18 is holding a knife pen 24, according to an exemplary embodiment of this invention. Knife pen 24 is shown as cutting a piece of adhesive label stock 20 into individual labels 26, 28, and 30. Plotter 12 is programmed to cut labels by causing the plotter to select knife pen 24 from carousel 22 and then causing plotter 12 to draw a continuous line around the area to be cut. Rounded edges are formed when knife pen 24 changes direction because, as will be explained further below, the knife blade is free to rotate within the shell of knife pen 24, and the cutting tip of the knife blade is not in the axis of rotation, causing blade to trail slightly when 90° turns are made, and thus rounding the corners. Friction of the material being cut against the cutting tip provides the change in direction of the blade when either the arm or the paper moves, so that the blade is always oriented to the cutting direction. Thus, no special programming is needed at PC 14 in order to control knife pen 24; knife pen 24 appears to the plotter and the programmer to be another pen. Furthermore, no special mechanical connections to change the direction of the cutting tip, because, as stated above, a change in the motion of the knife will cause the blade to change orientation to cut in the direction of motion. Cutting may be done before or after printing with regular pens.

Figure 2:
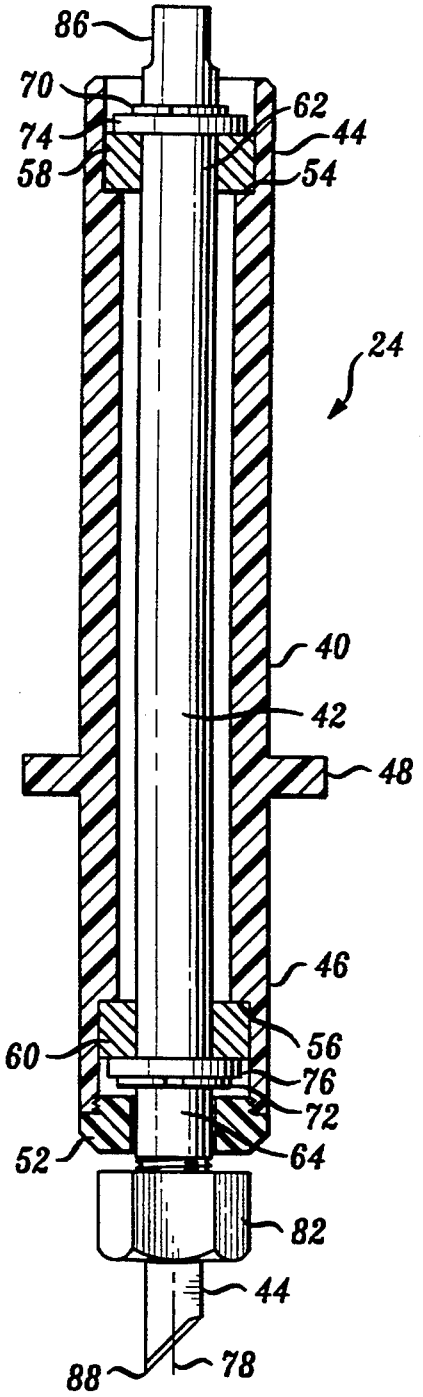
FIG. 2 is a cross section of a preferred embodiment of this invention.
Figure 3:
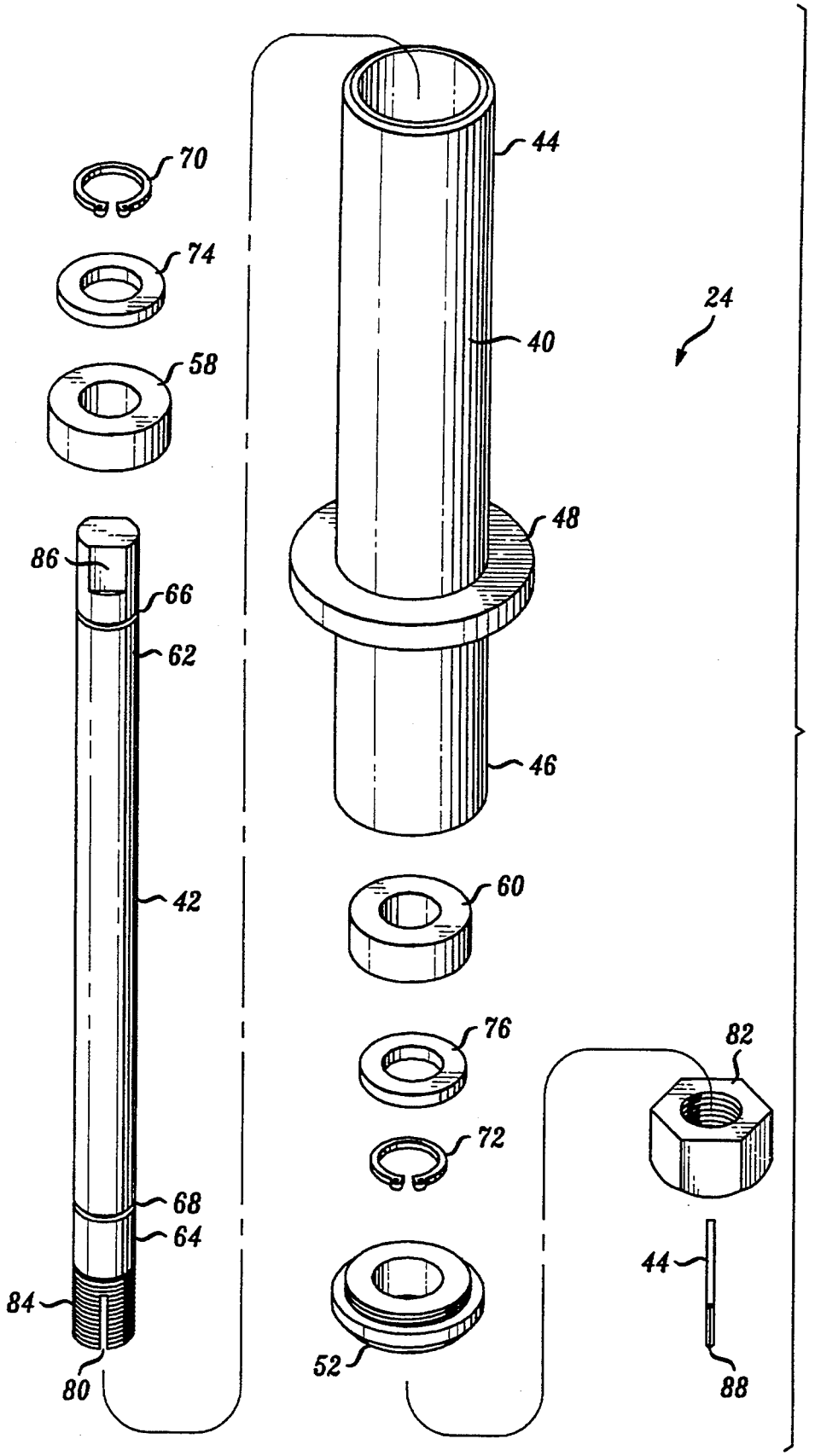
FIG. 3 is an exploded diagram of the embodiment of FIG. 2, wherein the shaft is rotated 90° from FIG. 2.

FIGS. 2 and 3 show an exemplary embodiment of the present invention in section view and exploded view respectively, and are described together. The knife pen 24 of this invention generally comprises a cylindrical outer shell 40, a central shaft 42 rotably mounted in outer shell 40, and a blade 44 fixedly mounted in shaft 42. Shell 40 comprises an upper end 44, a lower end 46, and a flange 48 which is generally disposed around the mid-section of shell 40. Flange 48 is disposed on shell 40 so that pen carriage 18 and carousel 22 of plotter 12 can hold shell 20 in proper alignment with base 16 as it would any other pen known in the art. Additionally, the height and outside diameter of shell 40 can vary in order to be appropriate to the plotter in which it is being used. Shell 40 is hollow and has a lower cap 52 disposed in lower end 46. Lower cap 42 includes an annular opening for shaft 42. Shell 40 also has a land 54 on the interior upper end and a land 56 on the interior lower end 46. These lands provide mountings for upper bearing 58 and lower bearing 60 respectively.

Shaft 42 also comprises an upper end 62 and lower end 64. Shaft 42 is received in shell 40 at bearing 58 and 60. Shaft 42 has an upper groove 66 and a lower groove 68 which receives snap rings 70 and 72 respectively. Snap ring 70 bears against washer 74 and snap ring 72 bears against washer 76 which retain shaft 42 within shell 40, while permitting shaft 42 to rotate around axis 78. Washer 74 bears against bearing 58, and washer 76 bears against bearing 60.

The lower end 64 of shaft 42 includes notch 80 for receiving blade 44. Blade 44 is retained in notch 80 by means of nut 82 and threaded portion 84 of the lower end 64 of shaft 42. Nut 82 is tightened by means of two wrenches as is known in the art, used on nut 82 and flats 86, which are disposed on the upper end 62 of shaft 42.

Blade 44 rotates around axis 78 whenever the direction of shell 40 is changed in relation to the material being cut. The friction of the material being cut against the tip 88 of blade 44, combined with the change of direction, causes blade 44 to define an are the size of which is dictated by the distance between the tip 88 of blade 44 and the center of rotation 78.

It is to be understood that the above-described embodiment is merely an illustrative principle of the invention and that many variations may be devised by those skilled in the art without departing from the scope of the invention. It is, therefore, intended that such variations be included withing the scope of the claims.

I claim:

1. A program controlled plotter for cutting material, said plotter comprising:

a base on which said material is mounted so that said material is movable in a first plane;

carriage means for holding plotter pens, said carriage means being movable relative to said first plane; and a knife carryable in said carriage means, said knife having a blade removably mounted in a shaft, said shaft having an upper end and a lower end, said lower end of said shaft having a notch for receiving said blade, said lower end of said shaft having a threaded portion for receiving a nut, said nut retaining said blade in said notch, said upper end of said shaft having an opposing pair of flats disposed so that said nut may be loosed and tightened by use of two wrenches applied to said nut and said pair of flats so that said blade is removable, said shaft also having an upper groove disposed in said upper end and a lower groove disposed in said lower end, said knife also having an annular shell, said shell having a first land on an upper end and a second land on a lower end, said shell having an upper bearing mounted on said first land and a lower bearing mounted on said second land, for retaining and supporting said shaft in said shell by means of an upper snap ring in said upper groove of said shaft riding on said upper bearing, and a lower snap ring in said lower groove of said shaft riding on said lower bearing so that said shaft rotates in said shell, said shell having a flange compatible with said plotter pens for mounting in said carriage means, so that said knife cuts said material on said base by being moved by said carriage means in conjunction with motion of said material on said base under control of a program.

2. The plotter of claim 1 wherein said knife is removable from said carriage means.

3. The plotter of claim 1 further including a carousel for holding a plurality of pens, wherein said knife is held for loading into said carriage means.

4. The plotter of claim 1 wherein said material comprises adhesive labels.

5. The plotter of claim 1 wherein said blade has a tip and said shaft has an axis, wherein said tip of said blade is offset from said axis, so that when a direction of cutting is changed, the cut defines an arc on said material.

6. The plotter of claim 1 wherein said blade rotates due to the action of friction of said tip of a blade on said material.

7. A knife for mounting in a program controlled plotter, said knife comprising:

a blade;

a shaft for holding said blade, said shaft having an upper end and a lower end, said lower end of said shaft having a notch for receiving said blade, said lower end of said shaft having a threaded portion for receiving a nut, said nut removably retaining said blade in said notch, said upper end of said shaft having an opposing pair of flats disposed so that said nut may be loosed and tightened by use of two wrenches applied to said nut and said pair of flats, said shaft also having an upper groove disposed in said upper end and a lower groove disposed in said lower end; and an annular shell, said shell having a first land on an upper end and a second land on a lower end, said shell having an upper bearing mounted on said first land and a lower bearing mounted on said second land, for retaining and supporting said shaft in said shell by means of an upper snap ring in said upper groove of said shaft riding on said upper bearing, and a lower snap ring in said lower groove of said shaft riding on said lower bearing so that said shaft rotates in said shell, said shell having a flange for interfacing with said plotter so that said blade moves in response to a program.

* * * * *